US012305264B2

(12) United States Patent
Ienaga et al.

(10) Patent No.: US 12,305,264 B2
(45) Date of Patent: May 20, 2025

(54) FLAME-RESISTANT MAGNESIUM ALLOY AND METHOD FOR PRODUCING THE SAME

(71) Applicant: HONDA MOTOR CO., LTD., Tokyo (JP)

(72) Inventors: Yuichi Ienaga, Saitama (JP); Yoichi Nosaka, Oita (JP)

(73) Assignee: HONDA MOTOR CO., LTD., Tokyo (JP)

( * ) Notice: Subject to any disclaimer, the term of this patent is extended or adjusted under 35 U.S.C. 154(b) by 70 days.

(21) Appl. No.: 17/437,832

(22) PCT Filed: Feb. 4, 2020

(86) PCT No.: PCT/JP2020/004071
§ 371 (c)(1),
(2) Date: Sep. 9, 2021

(87) PCT Pub. No.: WO2020/183980
PCT Pub. Date: Sep. 17, 2020

(65) Prior Publication Data

US 2022/0154314 A1 May 19, 2022

(30) Foreign Application Priority Data

Mar. 12, 2019 (JP) ..... 2019-044786

(51) Int. Cl.
*C22C 23/02* (2006.01)
*C22C 1/02* (2006.01)

(52) U.S. Cl.
CPC ..... *C22C 23/02* (2013.01); *C22C 1/02* (2013.01)

(58) Field of Classification Search
CPC . C22C 1/02; C22C 23/00; C22C 23/02; C22F 1/06
USPC ..... 420/410
See application file for complete search history.

(56) References Cited

U.S. PATENT DOCUMENTS

| | | | | |
|---|---|---|---|---|
| 5,078,962 | A | 1/1992 | Regazzoni et al. | |
| 5,681,403 | A | 10/1997 | Makino et al. | |
| 6,264,763 | B1 * | 7/2001 | Powell | C22C 23/02 420/407 |
| 6,544,357 | B1 * | 4/2003 | Hehmann | C23C 14/14 148/420 |
| 2002/0020475 | A1 * | 2/2002 | Sakamoto | C22C 23/02 420/407 |
| 2013/0183193 | A1 | 7/2013 | Kim et al. | |
| 2013/0280121 | A1 | 10/2013 | Kim et al. | |
| 2016/0348217 | A1 | 12/2016 | Ienaga et al. | |

FOREIGN PATENT DOCUMENTS

| | | | |
|---|---|---|---|
| CN | 102712969 | A | 10/2012 |
| CN | 102753715 | A | 10/2012 |
| CN | 104233027 | A | 12/2014 |
| CN | 106191585 | A | 12/2016 |
| CN | 108385006 | A | 8/2018 |
| JP | H0390530 | A | 4/1991 |
| JP | H0625790 | A | 2/1994 |
| JP | H0711374 | A | 1/1995 |
| JP | H07278717 | A | 10/1995 |
| JP | H08269609 | A | 10/1996 |
| JP | H09272945 | A | 10/1997 |
| JP | H09316586 | A | 12/1997 |
| JP | 3737440 | B2 * | 1/2006 |
| JP | 2007070688 | A | 3/2007 |
| JP | 2017061753 | A | 3/2017 |
| KR | 20030016879 | A * | 3/2003 |

OTHER PUBLICATIONS

NPL: on-line English translation of JP-3737440B2, Jan. 2006 (Year: 2006).*
NPL: on-line translation of KR 20030016879 A, Mar. 2003 (Year: 2003).*

* cited by examiner

*Primary Examiner* — Jie Yang
(74) *Attorney, Agent, or Firm* — CKC & Partners Co., LLC

(57) ABSTRACT

A flame-resistant magnesium alloy which suppresses occurrence of combustion of molten metal during alloy melting for casting and a method for producing the same are provided. By having a magnesium alloy which contains a specific amount of a specific element and also a specific amount of a rare earth element (RE) in a specific amount, an oxide file of a rare earth element (RE), which is dense, thin, and hardly breakable, is formed on an outermost surface of the molten metal. Specifically, provided is a flame-resistant magnesium alloy containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities and Al+8Ca≥20.5%.

2 Claims, No Drawings

FLAME-RESISTANT MAGNESIUM ALLOY AND METHOD FOR PRODUCING THE SAME

TECHNICAL FIELD

The present invention relates to a flame-resistant magnesium alloy and a method for producing the same. More specifically, the present invention relates to a flame-resistant magnesium alloy which suppresses occurrence of combustion of molten metal and has seizure resistance, and a method for producing the same.

BACKGROUND ART

Since magnesium is more lightweight than iron or aluminum, magnesium is under review as a lightweight substitute for members including a steel material or an aluminum alloy material. As a representative magnesium alloy, Mg—Al—Zn—Mn-based alloy (AZ91D alloy) containing 9% by weight of aluminum, 1% by weight of zinc, and 0.3% by weight of manganese, Mg—Al—Mn-based alloy (AM60B alloy) containing 6% by weight of aluminum and 0.3% by weight of manganese, or the like are known, for example.

However, due to lower strength at high temperatures, the magnesium alloy has a problem in terms of the development for a use application for which heat-resistant strength is required. In this regard, a magnesium alloy having improved heat-resistant strength according to addition of a rare earth element (RE) is suggested.

Patent Document 1 discloses a magnesium alloy containing 2 to 10% by weight of aluminum, 1.4 to 10% by weight of calcium, in which Ca/Al ratio is 0.7 or more, and also containing zinc, manganese, zirconium, and silicon, each at 2% by weight or less, and 4% by weight or less of at least one element selected from rare earth elements (for example, yttrium, neodymium, lanthanum, cerium, and mischmetal).

Furthermore, Patent Document 2 discloses a magnesium alloy containing 1.5 to 10% by weight of aluminum, 2.5% by weight or less of a rare earth element (RE), and 0.2 to 5.5% by weight of calcium is disclosed.

According to Patent Documents 1 and 2, when a rare earth element (RE) is contained in magnesium alloy, a magnesium alloy having sufficient strength even at high temperatures and excellent heat-resistant deformability in a pressurized part at high temperatures is obtained.

However, since the magnesium alloy sometimes shows an occurrence of combustion of molten metal during alloy melting for casting, the occurrence of combustion of molten metal becomes a significant problem in terms of the safety.

Patent Document 1: Japanese Unexamined Patent Application, Publication No. H06-025790

Patent Document 2: Japanese Unexamined Patent Application, Publication No. H07-278717

DISCLOSURE OF THE INVENTION

Problems to be Solved by the Invention

The present invention is devised in consideration of the above, and an object of the present invention is to provide a flame-resistant magnesium alloy which suppresses occurrence of combustion of molten metal during alloy melting for casting, and a method for producing the same.

Means for Solving the Problems

The present inventors carried out an intensive study on the occurrence mechanism of combustion of molten metal. In addition, the inventors believed that the combustion of molten metal is related with an oxide film formed on a surface of the molten metal. Specifically, on a surface of the molten metal which is a common molten magnesium alloy, a layer of magnesium oxide (MgO) is formed. Since MgO layer is porous, oxygen passes through the formed MgO layer, and eventually reaches the magnesium metal present inside. Due to this reason, even when the molten metal is kept in a static state, a common magnesium alloy may have an occurrence of combustion of molten metal that is caused by the oxygen reached the inside.

Next, in the case of a magnesium alloy containing calcium provided with flame resistance, a layer of magnesium oxide (MgO) is formed on a surface of molten metal, and on top of this layer, a stacked oxide film in which a layer of calcium oxide (CaO) is stacked is formed. Since the CaO film to become an outermost layer has a function of blocking oxygen, in a state in which the molten metal is kept in a static state, the combustion can be suppressed.

However, the CaO film present on the surface of the molten metal is dense but has a property of being thick and easily breakable. Due to this reason, in the case of stirring molten metal, a crack occurs in the CaO film present on the outermost surface, and the oxygen passing through the crack of the CaO film passes through the porous MgO film and eventually reaches the magnesium metal present inside. It is believed that the combustion of molten metal occurs, as a result.

In this regard, the present inventors have conducted studies on a method for forming a film hardly allowing an occurrence of a crack not only in the case of molten metal in a static state but also in the case of molten metal under stirring. As a result, they have found that, by having a magnesium alloy which contains a specific amount of a specific element and a specific amount of a rare earth element (RE) in a specific amount, an oxide film of a rare earth element (RE) can be formed on an outermost surface of the molten metal, and as the oxide film of the rare earth element (RE) is dense, thin, and hardly breakable, a crack in the oxide film can be suppressed even when the molten metal is stirred, thereby completing the present invention.

Namely, the present invention is a flame-resistant magnesium alloy containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities and $Al+8Ca \geq 20.5\%$.

In the flame-resistant magnesium alloy of the present invention, a compositional ratio Al/Ca between Al and Ca may be 1.7 or less.

Another aspect of the present invention is a flame-resistant magnesium alloy containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities, and having a $(Mg, Al)_2Ca$ phase continuous in a three-dimensional mesh shape.

Still another aspect of the present invention is a flame-resistant magnesium alloy containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities, and having a thermal conductivity of 80 W/m·K or higher and a tensile strength at 200° C. of 170 MPa or higher.

The flame-resistant magnesium alloy of the present invention may have a Ca—Mg—Si-based compound phase in a Mg mother phase.

In the flame-resistant magnesium alloy of the present invention, a Mg purity in a Mg mother phase may be 98.0% or more.

The rare earth element may be mischmetal.

Still another aspect of the present invention is a method for producing the aforementioned flame-resistant magnesium alloy, the method including a cooling step in which a molten metal material is cooled at a rate of less than $10^3$ K/second.

Still another aspect of the present invention is a method for producing the aforementioned flame-resistant magnesium alloy, the method including a crystallization step in which a molten metal material is cooled and a $(Mg, Al)_2Ca$ phase continuous in a three-dimensional mesh shape and a Mg mother phase containing a Ca—Mg—Si-based compound phase are crystallized.

The method tor producing a flame-resistant magnesium alloy of the present invention may further include a heat treatment step in which a heat treatment is carried out at 150 to 500° C.

Effects of the Invention

Since an oxide film of a rare earth element (RE) is formed on an outermost surface of the molten metal, the flame-resistant magnesium alloy of the present invention can suppress combustion of molten metal not only in the case of molten metal in a static state but also in the case of molten metal under stirring.

Furthermore, since a cast product cast from the flame-resistant magnesium alloy of the present invention has an oxide film of a rare earth element (RE), which does not react with iron to be a mold for casting, formed on the outermost surface, even in the casting area near a melt exit with high temperature, seizure can be suppressed. Namely, the flame-resistant magnesium alloy of the present invention is an alloy with improved seizure resistance, and as a result, the mold temperature during casting can be increased.

Preferred Mode for Carrying Out the Invention

Hereinbelow, embodiments of the present invention will be described. Incidentally, the present invention is not limited to the following embodiments.

<Flame-Resistant Magnesium Alloy>

The magnesium alloy of the present invention is a flame-resistant magnesium alloy containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities and Al+8Ca≥20.5%.

[Composition of Alloy]

The magnesium alloy of the present invention has a $(Mg, Al)_2Ca$ phase continuous in a three-dimensional mesh shape which is formed in a crystal grain boundary around a Mg mother phase (crystal grains), and a metal structure having a Ca—Mg—Si-based compound phase which is formed in the crystal grains (in the Mg mother phase). These intermetallic compound phases contribute to the enhancement of high-temperature strength of the magnesium alloy.

(Calcium: Ca)

Ca is an element that, is necessary for forming the aforementioned $(Mg, Al)_2Ca$ phase and the aforementioned Ca—Mg—Si-based compound phase, and as described below, Ca is present in a range satisfying Al+8Ca≥20.5%. When the Ca content is excessive, the ratio of Ca present; as a solid solution in the Mg mother phase increases to lower the purity of Mg in the Mg mother phase, and thus there is a possibility that lower-thermal conductivity is yielded. Due to this reason, Ca is less than 9.0% by mass, and preferably 5.0% by mass or less. Furthermore, the Ca content is preferably 2.5% by mass or more.

(Aluminum: Al)

Al is an element that is necessary for forming the aforementioned $(Mg, Al)_2Ca$ phase, and as described below, Al is present in a range satisfying Al+8Ca≥20.5%. When the Al content is excessive, the ratio of Al present as a solid solution in the Mg mother phase increases to lower the purity of Mg in the Mg mother phase, and thus there is a possibility that lower thermal conductivity is yielded. Due to this reason, Al is less than 5.7% by mass, and preferably 5.0% by mass or less, and when the thermal conductivity is considered most important, Al is more preferably 3.0% by mass or less. Furthermore, the Al content is 0.5% by mass or more, and preferably 1.0% by mass or more.

(Compositional Ratio Between Calcium: Ca and Aluminum: Al)

In the magnesium alloy of the present invention, Ca and Al need to satisfy a relation of the following Formula (1).

$$Al+8Ca \geq 20.5\% \quad (1)$$

When Ca and Al satisfy the relation of the above Formula (2), the aforementioned $(Mg, Al)_2Ca$ phase is formed, and as a result, the high-temperature strength can be enhanced. Al+8Ca is preferably 24.0% or more. On the other hand, when the content of Al and Ca is excessive, the purity of Mg in the Mg mother phase is lowered so that there is a possibility that lower thermal conductivity is yielded, and thus Al+8Ca is preferably 45.0% or less. The reason why the content is preferably 45.0 or less is that Al=5 or less and Ca=5 or less are preferred.

In the magnesium alloy of the present invention, Al/Ca, i.e., a ratio of Al to Ca, is preferably 1.7 or less. As described above, Al forms a $(Mg, Al)_2Ca$ phase with Ca. However, when Al is contained excessively, the ratio of excess Al present as a solid solution in the Mg mother phase increases, and thus there is a possibility that lower purity of Mg in the Mg mother phase is yielded. When Al/Ca is 1.7 or less, Al present as a solid solution in the Mg mother phase is suppressed so that the thermal conductivity can be enhanced. Al/Ca is even more preferably 1.2 or less. Incidentally, to form the aforementioned $(Mg, Al)_2Ca$ phase, Al/Ca is preferably 0.2 or more.

(Silicon: Si)

Si is an element that is necessary for forming the aforementioned Ca—Mg—Si-based compound phase. However, when the Si content is large, a coarse SiCa-based compound resulting from association with Ca is produced to become a factor which inhibits the formation of the $(Mg, Al)_2Ca$ phase in a continuous three-dimensional mesh shape and reduces the high-temperature strength of the magnesium alloy. Due to this reason, the Si content is 1.3% by mass or less, and preferably 1.0% by mass or less. Incidentally, to form a Ca—Mg—Si-based compound phase, the Si content is preferably 0.2% by mass or more.

(Rare Earth Element: RE)

The flame-resistant magnesium alloy of the present invention contains a rare earth element (RE). As a specific amount of the rare earth element (RE) is present in the flame-resistant magnesium alloy of the present invention, an oxide film of the rare earth element (RE) is formed on an outermost surface of the molten metal. Due to this reason, combustion of molten metal can be suppressed not only in the case of molten metal in a static state but also in the case of molten metal under stirring.

Furthermore, when a cast product is produced from the flame-resistant magnesium alloy of the present invention, an oxide film of a rare earth element (RE) is formed on a surface of the cast product. Since the oxide film of the rare earth element (RE) does not react with iron to be a mold during casting, seizure can be suppressed even in the casting area near a melt exit with high temperature. Namely, by having a alloy, the flame-resistant magnesium alloy of the present invention becomes an alloy with improved seizure resistance and the mold temperature during casting can be increased.

The content of the rare earth element is 0.4% by mass or more, and preferably 0.6% by mass or more. Furthermore, the content of the rare earth element is less than 1.3%, and moreover, the content thereof is preferably an amount not allowing the forming of unnecessary compounds, for example, is preferably less that 1.0%.

Examples of the rare earth element (RE) include scandium, yttrium, lanthanum, cerium, praseodymium, neodymium, promethium, samarium, europium, gadolinium, terbium, dysprosium, holmium, erbium, thulium, ytterbium, and lutetium, and one kind or two or more kinds thereof can be used. In the present invention, among these, cerium (Ce) or lanthanum (La) is preferable from the viewpoint of being effective for enhancing the corrosion resistance of the magnesium alloy and being easily obtainable as mischmetal.

Furthermore, in the flame-resistance magnesium alloy of the present invention, the rare earth element is preferably contained as mischmetal (Mm). Mischmetal (Mm) is a mixture of rare earth metals. Specifically, mischmetal Is a mixture which contains about 40 to 50% of cerium (Ce) and about 20 to 40% of lanthanum (La) that are purified after purification of Nd. Since the rare earth elements are expensive when they are separated as a single compound, by using mischmetal with relatively low price, cost of the flame-resistant magnesium alloy to be obtained can be reduced.

(Manganese: Mn)

The flame-resistant magnesium alloy of the present invention preferably contains Mn. Mn has a function of enhancing the corrosion resistance of the magnesium alloy. The content of Mn is preferably 0.1% or more and 0.5% or less, and more preferably 0.2% or more and 0.4% or less.

In the flame-resistant magnesium alloy of the present invention, the remaining is Mg and inevitable impurities. The inevitable impurities are not particularly limited and are included in a range in which they do not exhibit any influence on the properties of the present magnesium alloy.

(Purity of Mg in Mg Mother Phase)

The purity of Mg in the Mg mother phase means the content ratio of Mg in crystal grains of the metal structure of the magnesium alloy. In the magnesium alloy of the present invention, higher the purity of Mg in the Mg mother phase is, better the thermal conductivity of the Mg mother phase and better the thermal conductivity of the magnesium alloy are obtained. On the other hand, when the purity of Mg is lowered due to solid solution of components other than Mg in the Mg mother phase, the thermal conductivity of the magnesium alloy is also easily lowered.

In the flame-resistant magnesium alloy of the present invention, the purity of Mg in the Mg mother phase is preferably 93.0% or more. When the purity of Mg in the Mg mother phase is 98.0% or more, thermal conductivity of 80.0 W/m·K or higher is obtained. More preferred purity of Mg in the Mg mother phase is 99.0% or more.

(Mg, Al)$_2$Ca Phase Continuous in Three-Dimensional Mesh Shape)

The magnesium alloy of the present invention has a (Mg, Al)$_2$Ca phase continuous in a three-dimensional mesh shape. The (Mg, Al)$_2$Ca phase continuous in a three-dimensional mesh shape is expressed as Mg, Ca, and Al form, during casting of a magnesium alloy, a network structure in a crystal grain boundary around the Mg mother phase (crystal grains). By having the (Mg, Al)$_2$Ca phase continuous in a three-dimensional mesh shape in a crystal grain boundary, the magnesium alloy of the present invention becomes an alloy with enhanced tensile strength at high temperatures.

(Ca—Mg—Si-Based Compound Phase)

The magnesium alloy of the present invention has a Ca—Mg—Si-based compound phase in the Mg mother phase. Strength inside the crystal grains is reinforced by the Ca—Mg—Si-based compound phase, and thus the high-temperature strength of the magnesium alloy tends to get; enhanced.

(Thermal Conductivity)

AZ91D, which is a conventional and commercially available magnesium alloy, has a thermal conductivity of 51 to 52 W/m·K. On the other hand, aluminum alloy (ADC12 material) has a thermal conductivity of 92 W/m·K, and the thermal conductivity of AZ91D is only half or so of the aluminum alloy. Due to this reason, the conventional and commercially available magnesium alloy does not have a sufficient heat dissipating property for a material of high-temperature parts.

In this regard, the thermal conductivity of the magnesium alloy of the present invention is 80.0 W/m·K or higher. Due to this reason, the magnesium alloy of the present invention has a favorable heat dissipating property as a material of high-temperature parts and can be suitably used, for example, as a flame-resistant magnesium alloy for engine members. Incidentally, to ensure the sufficient heat dissipating property for a material of high-temperature parts, the thermal conductivity is more preferably 90.0 W/m·K or higher, and even more preferably 100.0 W/m·K or higher.

(High-Temperature Strength)

In a high temperature range of about 200° C., a typical, magnesium alloy has lower mechanical properties such as tensile strength and elongation, and thus the high-temperature strength comparable to the heat-resistant aluminum alloy (ADC12 material) has not been obtained. In this regard, the magnesium alloy of the present invention has high-temperature strength that the tensile strength at 200° C. is 170 MPa or higher. Due to reason, the magnesium alloy of the present invention can be suitably used, for example, as a flame-resistant magnesium alloy for engine members that are used under high temperature conditions. The tensile strength at 200° C. is preferably 185 MPa or higher, and more preferably 200 MPa or higher.

<Method for Producing Flame-Resistant Magnesium Alloy>

As for the method for producing a magnesium alloy of the present invention, although not particularly limited, a method in which a metal material containing, in terms of % by mass, less than 9.0% of Ca, 0.5% or more but less than 5.7% of Al, 1.3% or less of Si, and 0.4% or more but less than 1.3% of a rare earth element with the remaining consisting of Mg and inevitable impurities and Al+8Ca≥20.5 is melt at high temperatures is mentioned, for example. As for the method for melting at high temperatures, although not particularly limited, a method in which a metal material is injected to a graphite crucible and high frequency Induction melting is carried out under Ar atmosphere for melting the metal material at a temperature of 750 to 850° C. is mentioned, for example.

The obtained molten alloy can be cast after injection into a mold. For casting, it is preferable that the molten metal material is cooled at a predetermined rate.

In the method for producing a magnesium alloy of the present invention, it is preferable to include a crystallization step in which the molten metal material is cooled and a $(Mg, Al)_2Ca$ phase continuous in a three-dimensional mesh shape and a Mg mother phase containing a Ca—Mg—Si-based compound phase are crystallized. Accordingly, while having both the mechanical properties and thermal conductivity, a magnesium alloy which suppresses combustion of molten metal not only in the case of molten metal in a static state but also in the case of molten metal under stirring, and in which seizure resistance is improved can be obtained.

Incidentally, the cooling rate is preferably less than $10^3$ K/second. When the cooling rate is less than $10^3$ K/second, time for the elements in solid solution in the mother phase to get discharged into the crystallization phase becomes sufficient, and as a result, it is difficult for the elements in solid solution to remain in the Mg mother phase so that the thermal conductivity of a magnesium alloy to be obtained is not likely to get lowered. The cooling rate is preferably $10^2$ K/second or less.

The method for producing a magnesium alloy of the present invention may further include a heat treatment step in which a heat treatment at 150 to 500° C. is carried out. The temperature for the heat treatment is preferably in a range of 200 to 400° C.

The time for the heat treatment is, although not particularly limited, preferably in a range of 1 to 6 hours.

A magnesium alloy for which the heat treatment step has been carried out can have higher thermal conductivity compared to a magnesium alloy for which the heat treatment step has not been carried out.

<Application>

The magnesium alloy of the present invention has high-temperature strength, and simultaneously, by suppressing temperature increase or thermal expansion, can optimize the clearance of a molded article. Furthermore, the magnesium alloy of the present invention has lower specific gravity compared to a conventional aluminum alloy, and specifically, enables lightweighting by 30% or more. Due to this reason, the magnesium alloy of the present invention can be preferably used for a use application for which high-temperature strength and lightweighting are required and can be suitably used, for example, as an engine block of an automobile or the like, or engine parts such as piston or cylinder. Furthermore, the magnesium alloy of the present invention can contribute to the improvement of fuel efficiency or quietness of an engine of a transporting machine such as an automobile.

EXAMPLES

Next, the present invention will be described in more detail based on Examples, but the present invention is not limited thereto. Incidentally, unless specifically described otherwise, "ppm" described in Examples and Comparative Examples indicates "ppm by mass".

Example 1

[Preparation of Molten Metal]

A metal material having 4.5% by mass of Al, 4.0% by mass of Ca, 0.3% by mass of Si, 0.3% by mass of Mn, and 0.6% by mass of mischmetal (Mm) added to Mg was injected to a crucible, subjected to high frequency induction melting under Ar atmosphere, and melt at a temperature of 750 to 850° C. to obtain a molten alloy (molten metal).

[Production of Cast Product]

Subsequently, the obtained molten alloy (molten metal) was cast by injection into a mold, and according to die cast (DC) casting, an engine block was produced.

Subsequently, the obtained engine block was subjected to a heat treatment at 300° C. for 4 hours to obtain a heat-treated engine block.

For the obtained engine block and heat-treated engine block, the thermal conductivity (room temperature) and the tensile strength (200° C.) were measured. The results are shown in Table 1.

TABLE 1

| Example 1 | Thermal conductivity (at room temperature) | Tensile strength (at 200° C.) |
|---|---|---|
| Engine block | 82.2 W/m · K | 188 MPa |
| Heat-treated engine block | 98.6 W/m · K | 174 MPa |

Comparative Example 1

A molten alloy (molten metal) was obtained in the same manner as in Example 1, except that the mischmetal (Mm) wad not added, and an engine block was produced from the obtained molten alloy (molten metal).

Comparative Example 2

A molten alloy (molten metal) was obtained in the same manner as in Example 1, except that Y was added at 0.3% instead of the mischmetal (Mm), and an engine block was produced from the obtained molten alloy (molten metal).

<Evaluation>

For Examples and Comparative Examples, the following evaluations were carried out.

[Presence or Absence of Combustion of Molten Metal]

For the molten alloys (molten metals) obtained from Examples and Comparative Examples, presence or absence of combustion of molten metal was observed at the time of melting (in a static state), during die cast (DC) casting (in a stirring state), and in a static state after the die cast (DC). Furthermore, the oxide film formed on a surface of the molten metal after the die cast was picked up and observed by visual inspection. The results are shown in Table 2.

[Seizure Resistance]

For the obtained engine block, presence or absence of seizure was checked by visual inspection. The results are shown in Table 1. From the engine block obtained in Example 1, seizure was not observed even in the area near a melt exit in which the temperature increases during casting. On the other hand, the engine blocks obtained in Comparative Example 1 and Comparative Example 2, seizure was observed near the melt exit.

It is recognized that the engine block obtained in Example 1 has an oxide film of a rare earth element (RE), which does not react with iron as a mold material, formed on a surface thereof, and the seizure is suppressed even in the area near a melt exit with high temperature. On the other hand, the engine blocks obtained in Comparative Example 1 and Comparative Example 2 has a surface formed of a calcium oxide film, and due to this reason, a reaction with iron as a mold occurred to yield an occurrence of seizure.

TABLE 2

| | Presence or absence of combustion of molten metal | | | | |
|---|---|---|---|---|---|
| | At the time of melting (In static state) | During die cast (DC) (In stirring state) | After die cast (DC) (In static state) | Oxide film of molten metal | Seizure resistance |
| Example 1 | No combustion | No combustion | No combustion | Thin | Without seizure |
| Comparative Example 1 | Combustion was shown, but self-extinguished | Combustion after 4 minutes | Combustion continued | Thick | With seizure |
| Comparative Example 2 | Combustion was shown, but self-extinguished | No combustion | Combustion was shown, but self-extinguished | Thin | With seizure |

The invention claimed is:

1. A flame-resistant magnesium alloy comprising, in terms of % by mass, less than 9.0% of Ca, 0.5% or more but less than 5.7% of Al, 0.2% or more and 1.3% or less of Si, 0.1% or more and 0.5% or less of Mn, and 0.6% or more but less than 1.0% of a rare earth element with the remaining consisting of Mg and inevitable impurities, the rare earth element is mischmetal, the mischmetal includes 40 to 50% of cerium and 20 to 510% of lanthanum, Al/Ca is 1.2 or less, and a metallic structure having a $(Mg, Al)_2Ca$ phase continuous in a three-dimensional mesh shape, in a crystal grain boundary around a crystal grain constituting a Mg mother phase, and having a Ca—Mg—Si-based compound phase inside the crystal grain of the Mg mother phase.

2. The flame-resistant magnesium alloy according to claim 1, wherein a Mg purity in a Mg mother phase is 98.0% or more.

* * * * *